US005453567A

United States Patent [19]

Brinson

[11] Patent Number: 5,453,567

[45] Date of Patent: Sep. 26, 1995

[54] AUTOMATIC OPERATION OF PERCUSSION INSTRUMENTS

[76] Inventor: Shelby Brinson, 3128 E. Baldwin Rd., Panama City, Fla. 32405

[21] Appl. No.: 178,735

[22] Filed: Jan. 7, 1994

[51] Int. Cl.[6] ..... G10F 1/08

[52] U.S. Cl. ..... 84/104; 84/411 R; 84/422.3

[58] Field of Search ..... 84/104, 411 R, 84/422.3

[56] References Cited

U.S. PATENT DOCUMENTS

| | | | |
|---|---|---|---|
| 965,435 | 7/1910 | Brauer | 84/104 |
| 1,685,090 | 9/1928 | Lifshitz | 84/104 |
| 5,028,776 | 7/1991 | Forti et al. | 84/421 X |
| 5,270,480 | 12/1993 | Hikawa | 84/104 |

*Primary Examiner*—Steven L. Stephan
*Assistant Examiner*—Patrick J. Stanzione
*Attorney, Agent, or Firm*—Gerald E. Linden

[57] ABSTRACT

The actuation of a percussion instrument, such as a high-hat cymbal set, is automatically implemented without requiring the performer (drummer) to use his (her) foot. This allows the drummer to use both feet for other instruments, such as for double-footed bass drumming. An automatic mechanism operates in either a tracking or "metronome" or a "track" mode to strike the instrument in a variety of beats, rhythms and tempos. The automatic mechanism may attach to a footpedal for operating the instrument, or may be connected directly to the instrument.

26 Claims, 3 Drawing Sheets

AUTOMATIC OPERATION OF PERCUSSION INSTRUMENTS

TECHNICAL FIELD OF THE INVENTION

The present invention relates to accessories for percussion instruments, particularly the "high-hat" cymbals.

BACKGROUND OF THE INVENTION

A drum set typically consists of an assortment of individual percussion instruments such as a bass drum, various smaller snare drums, tom-toms, cymbals and a "high-hat" cymbal. These percussion instruments are generally operated by striking a surface of the instrument with a stick or mallet.

For example, a drum set may include both a bass drum and a high-hat, each of which is operated by a foot pedal which the user (performer) steps upon to strike (or operate) the respective instrument. For purposes of this discussion, striking an instrument includes operating a foot pedal to cause a percussion instrument to sound.

Recently, double foot pedals for the bass drum have become in vogue (de-rigueur for top performers). Two spaced-apart pedals allow the performer to execute more complex and rapid rhythms (e.g., bass drum "riffs"), using both feet (rather than only one foot). However, when using both feet on a double foot pedal for the bass drum, the performer must cease double-footed bass drumming (e.g., revert to single-footed bass drumming) in order to operate the high-hat foot pedal with one of his feet. As is evident, the performer is faced with the undesirable mutually exclusive choice of operating both instruments, each with a single foot, or of operating only the bass drum with both feet. Moreover, the transition from one foot pedal (e.g., for the bass drum) to another foot pedal (e.g., for the high-hat) is especially cumbersome transition for the performer to make while trying to perform.

SUMMARY OF THE INVENTION

It is therefore an object of the present invention to provide an improved technique for operating a percussion instrument.

It is a further object of the invention to provide means for automatically operating at least one percussion instrument, such as the high-hat, which is normally operated by the performer's foot, without requiring the performer to apply his foot to the foot pedal.

According to the invention, an automatic percussion instrument operating mechanism (APIOM) is provided for operating a percussion instrument, such as the high-hat cymbal of a drum set. Preferably, the mechanism is retro-fittable onto an existing drum set having a foot pedal for operating the high-hat.

The APIOM includes any suitable mechanism for performing work (applying force over a distance), including electrical and hydraulic mechanisms.

According to a feature of the invention, the APIOM can operate in a "metronome" mode, operating the instrument at a selectable tempo. Alternatively, the APIOM can operate in a "track" mode, operating the instrument at a tempo related to a tempo established by the operation of other of the percussion instruments (such as the bass drum).

According to a feature of the invention, in either of the metronome or track modes, the rhythm laid down by the APIOM is selectable. In other words, the APIOM can be caused to operate the instrument on every beat (e.g., 1-2-3-4), or on every other beat (1–3), for example.

According to a feature of the invention, in either of the metronome or track modes, selected ones of the instrument operations can be emphasized (accented) or de-emphasized.

The invention is beneficial because it allows the performer to operate the high-hat while double-footed bass drumming. This allows for a fuller sound to be delivered from the drum set, such as including both double-footed bass drumming and contemporaneous high-hatting.

Other objects, features and advantages of the invention will become apparent in light of the following description thereof.

DETAILED DESCRIPTION OF THE INVENTION

Figure 1:
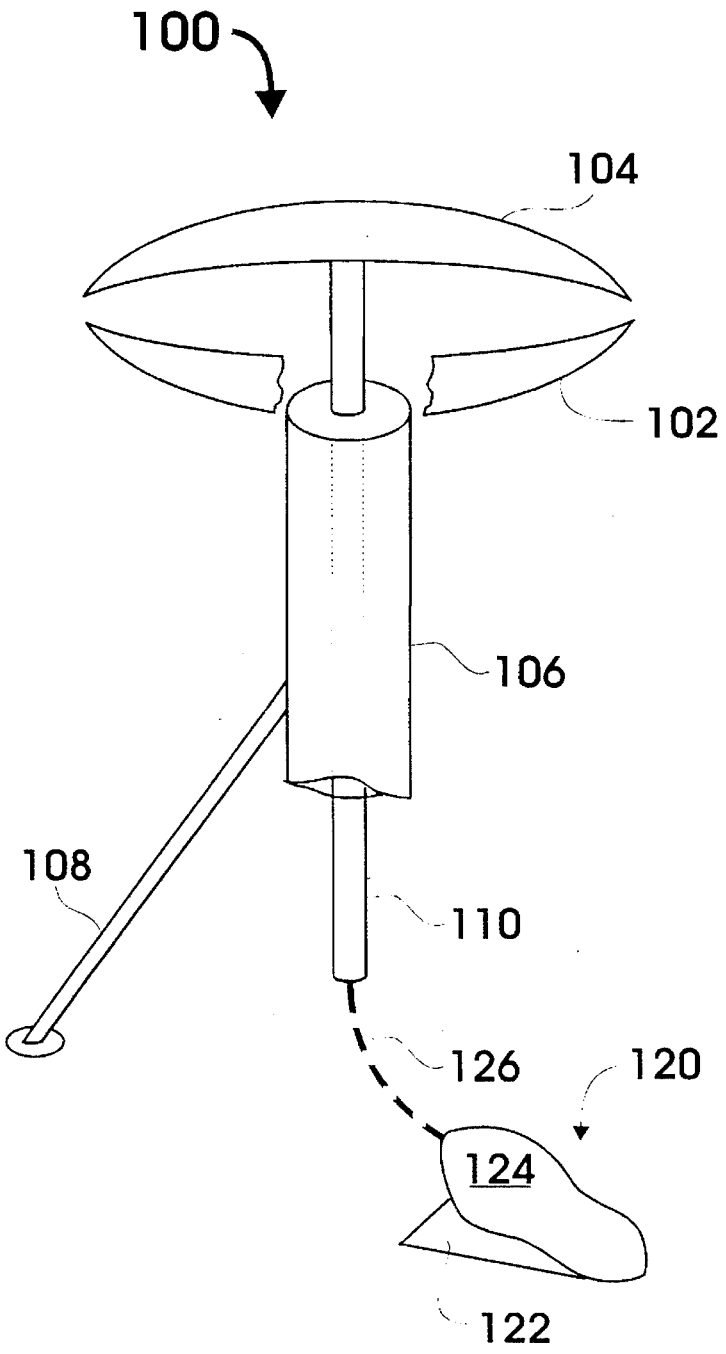
Figure 1 (Prior Art)
FIG. 1 is a generalized perspective view of a typical high-hat cymbal, showing how a foot pedal causes the high-hat to sound.

FIG. 1 shows a stylized high-hat cymbal 100, exemplary of a percussion instrument. The high-hat generally includes a one upward-facing cymbal 102, and an other downward-facing cymbal 104. The upward-facing cymbal is fixed to an upright element (stand) 106 which is supported by a number of legs 108 (only one leg shown, for illustrative clarity) on a floor surface. The downward-facing cymbal 104 is attached to a rod 110 extending through the upright element 106, and the rod is moveable up and down. When the rod 110 moves down, the upper cymbal 104 contacts the lower cymbal 102, and the instrument emits a sound. Generally, a spring (not shown) maintains the upper cymbal separated from the lower cymbal. A drummer may also tap the upper cymbal 104 with a drumstick, but this is not particularly germane to the present invention.

Generally, the high-hat is operated by a foot pedal 120 (shown quasi-schematically) which has a fixed part 122 resting on the floor surface and a moveable part 124 hinged at one end to the fixed part 122. A suitable linkage, such as a chain 126 (shown as a dashed line) pulls down on the rod 110 to sound the cymbals.

Figure 2:
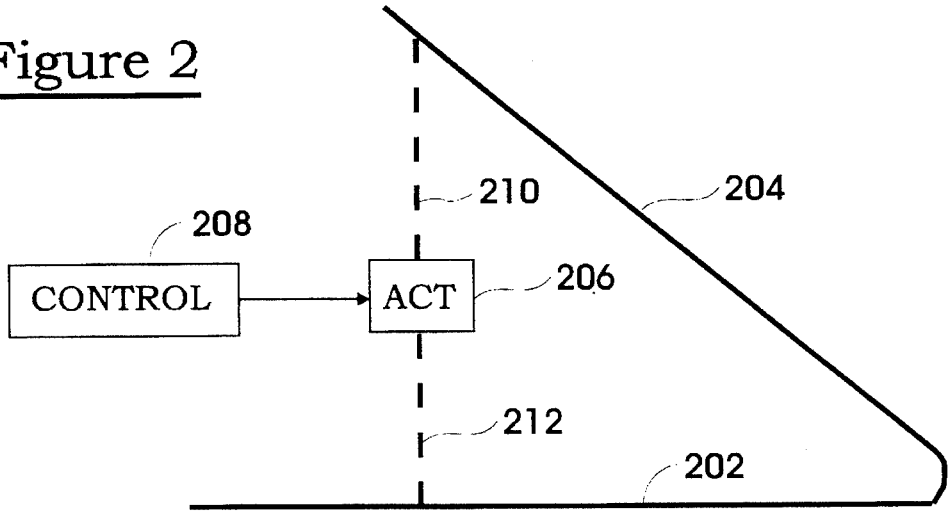
FIG. 2 is a schematic side view of an embodiment of the automatic percussion instrument operating mechanism (APIOM) of the present invention, retro-fitted to a foot pedal such as the foot pedal of FIG. 1.

FIG. 2 shows the automatic percussion instrument operating mechanism (APIOM) 200 of the present invention, retro-fitted to a foot pedal such as the foot pedal 120 of FIG. 1. A generalized foot pedal having a fixed part 202 and a moveable part 204 are schematically illustrated.

The APIOM 200 includes an actuator element 206 and a control mechanism 208. Generally, the actuator 206 is operable to depress the moveable part 204 of the foot pedal in response to the direction of the control mechanism 208, and is mechanically linked to the moveable part 204 by a suitable linkage 210 (shown as a dashed line). Evidently, as will be understood, the actuator should be anchored in any suitable manner to the floor surface. For example, a linkage 212 (dashed lines) is shown anchoring the actuator to the fixed element 202 of the foot pedal. By using the APIOM, the high-hat cymbal may be operated without the performer pressing on the foot pedal with his (her) foot. A number of modes of operation are discussed in greater detail hereinbelow, as well as particulars of how the APIOM is connected to the foot pedal or directly to the instrument (e.g., high-hat) itself. FIG. 2 is meant to illustrate the general function of the present invention.

Figure 2A:
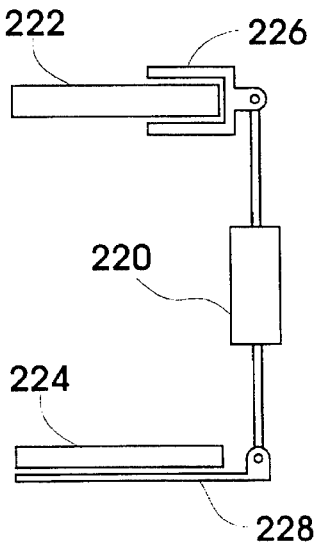
FIG. 2*a* is a view of an exemplary embodiment of the APIOM, retro-fitted to a footpedal.

FIG. 2*a* shows how an actuator 220 (such as 206) is suitably attached (retro-fitted) to an existing footpedal, and shows in end view the movable element 222 (204) and the stationary element 224 (202) of a footpedal (greatly simplified for illustrative clarity). The salient features of this arrangement are that the APIOM is provided with:

a bracket 226 which secures to the movable footpedal element 222, so that the actuator can cause the moveable element to move downward, thereby sounding the instrument; and a bracket 228 which fits underneath (is secured or connected to) the stationary footpedal element 224, giving the APIOM a stationary base from which to apply the force to the moveable element 222.

In FIG. 2*a*, the actuator 220 is shown between the moveable and stationary elements of the footpedal, which may interfere with or limit the stroke of the footpedal. It is within the scope of this invention that the actuator be disposed atop the moveable footpedal element, so that it pushes the moveable element down (rather than pulling it down). It is also within the scope of this invention that the actuator interact with the footpedal through a more complex (e.g., scissors) mechanism than is illustrated.

Figure 2B:
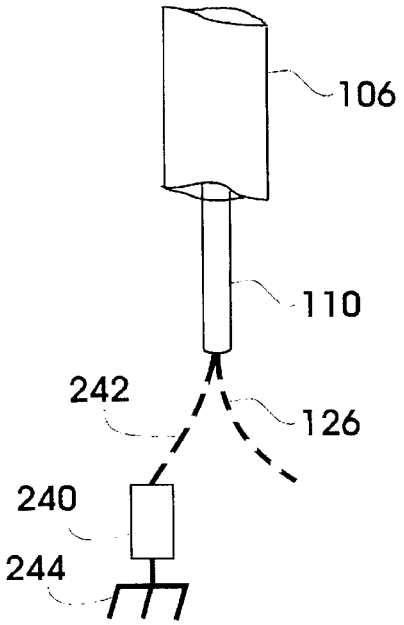
FIG. 2*b* is a view of an exemplary embodiment of the APIOM, attached directly to a percussion instrument.

FIG. 2*b* shows how an actuator 240 (such as 206) is suitably attached directly to a percussion instrument. Borrowing from FIG. 1, there is shown the upright element 106 and through-rod 110 of a high-hat, as well as the linkage 126 to the footpedal. In this example, an additional linkage 242 is connected to the bottom of the rod 110, so that either of the actuator 240 or the footpedal (not shown) can operate the instrument. Evidently, the actuator 240 must be anchored in some manner. This is indicated by the schematic element 244, which may be similar to the bracket 228 (FIG. 2*a*), a bracket extending under a leg (108) of the instrument, or simply a suitable mass (weight).

Figure 3:
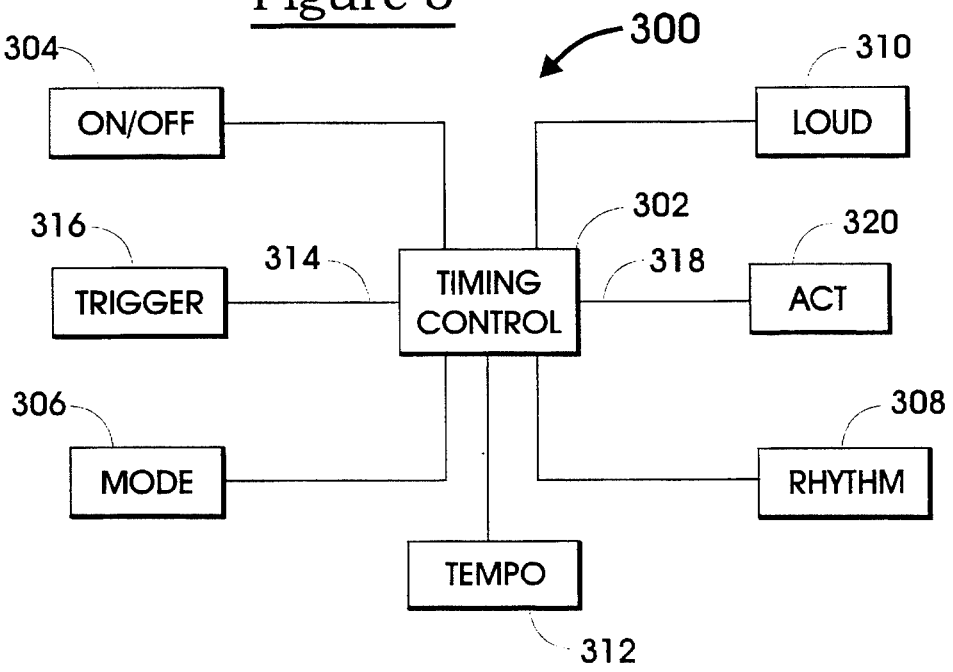
FIG. 3 is a block diagram of an embodiment of the APIOM of the present invention, illustrating the control and operation of same, including the various operating modes.

FIG. 3 is a block diagram of a suitable control mechanism 300 (208) for an embodiment of the APIOM employing an electrical actuator, such as a solenoid. It is within the scope of this invention that the actuator would be hydraulic or pneumatic.

The control mechanism 300 includes the following major components:

a timing and control circuit 302, which may be analog, digital, or microprocessor-based;

a switch (ON/OFF) 304, for turning the mechanism on and off which may be a footswitch;

a switch ("MODE") 306, for selecting between the metronome and track modes;

a switch ("RHYTHM") 308, for selecting between various rhythms;

a switch ("LOUD") 310, for selecting from a range of loudnesses, which may be a rheostat-type control rather than a switch.

a switch ("TEMPO") 312, for selecting the tempo, or speed, at which the mechanism 300 operates the instrument, which may be a rheostat-type control rather than a switch.

The functions of the various switches and rheostats can be combined into a fewer number of switches, for example by combining the ON/OFF switch 304 with the loudness control 310.

The mechanism 300 is further provided with an input line 314 over which a suitable trigger mechanism (TRIGGER) provides signals in the track mode.

The mechanism 300 is further provided with an output line for operating the actuator 320 (e.g., solenoid 206).

In either of the metronome modes, the actuator 320 is sequentially actuated by a corresponding sequence of signals provided on the line 318.

Figure 3A:
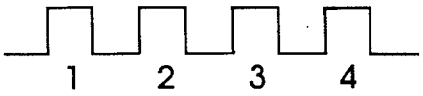
FIG. 3*a* is a timing diagram of an exemplary embodiment of signals generated by the APIOM of the present invention.
Figure 3B:
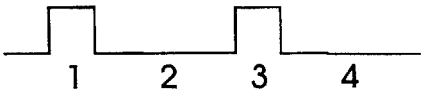
FIG. 3*b* is a timing diagram of another exemplary embodiment of signals generated by the APIOM of the present invention.

In the metronome mode, selected by the performer with the mode switch 306, the mechanism 300 operates in an open-loop manner, controlling the actuator at a steady, fixed rate that is selected by the performer with the tempo switch 312. The rhythm at which the instrument is desired to be sounded is selected by the performer with the rhythm switch 308. For example, as shown in FIG. 3*a*, a simple 1-2-3-4 rhythm can be selected, in which case the instrument will sound on all of the four beats (i.e., in 4/4 time). As shown in FIG. 3*b*, the performer can also select a different rhythm wherein the instrument will sound only on the first and third beats of the tempo. It is within the scope of this invention that the instrument can be caused to sound on any beats, as well as between any of the beats of a given tempo. (For example, on and between the beats:

one and a two, three and a four (eight soundings per 4/4 measure); or one, two, three, four and (five soundings per 4/4 measure).

In the metronome mode, the timing of the timing/control circuit is related to a fixed stream of pulses, which may be generated by a timing mechanism (e.g., clock circuit) within the timing/control circuit 302.

In the track mode, selected by the performer with the mode switch 306, the timing of the timing/control circuit 302 is related to the frequency of trigger pulses coming over the line 314. Generally, these trigger pulses are provided by the sensor 316, which may be a microphone placed near one of the other instruments of the drum set. For example, a microphone (and low pass filter, not shown) can be placed near the bass drum so that it picks up the tempo (beats) established (laid down) by the performer's bass drumming. In the track mode, the performer's regular beat (e.g., 1-2-3-4), translated into trigger signals for the timing/control circuit, is a suitable (one-for-one) substitute for clock pulses in the metronome mode. In the event that the bass drum beat is irregular (e.g., one and a two, three and a four), the timing/control circuit 302 is provided with a an "averaging" function which will extract the basic beat from the more complex bass drum beat. For example, a regular stream of clock-type pulses (1-2-3-4) can be extracted from irregular (one and a two, three and a four) trigger signals. In this manner, a regular tempo for automatically operating the percussion instrument can be established, irrespective of irregularities in the sensed beats. For example, it is elementary to construct a circuit, or program a microprocessor, to "ignore" the "and" beat of a sensed "one-two-three-four-and".

It is within the scope of this invention that the trigger sensing device 316 is other than a microphone. For example, the trigger sensing device 316 could be a microswitch located on the bass drum pedal, or on one of the two pedals in a double-footed bass drum pedal set.

In summary, the APIOM can operate in a "metronome" mode, operating the instrument at a tempo selected by the performer. Alternatively, the APIOM can operate in a "track" mode, operating the percussion instrument at a tempo related to (e.g., derived from) a beat that the performer establishes on another of the percussion instruments in the drum set (such as the bass drum). Further, in either of the metronome or track modes, the rhythm laid down by the APIOM is selectable. In other words, the APIOM can be caused to operate the instrument on every beat (e.g., 1-2-3-4), or on every other beat (1–3), for example.

One skilled in the art to which the present invention most nearly pertains will understand how to implement the functions described herein in a given timing/control circuit. To this end, the illustration of FIG. 3 can readily be interpreted as a software block diagram for a microprocessor-controlled mechanism 300.

Further according to the invention, in either of the metronome or track modes, the work (force times distance) applied to the percussion instrument can be varied. Generally, the more work that is performed by the actuator, the louder the instrument will sound. For example, two solenoid actuators can be operated in series (to double the distance) or parallel (to double the force) at which the instrument is struck. The performer has the option of selecting the loudness, ranging from soft to loud, at which the instrument will sound. For example, for soft strikes, only one of two series or parallel connected solenoids can be actuated (and for loud strikes, both solenoids can be actuated). Depending on the particular actuator(s) employed, the performer will be able to select from an entire range of loudnesses.

This ability for the performer to select the loudness at which the instrument will sound, it is also within the scope of this invention that even more complex rhythms than those set forth hereinabove can be generated by the mechanism 300. For example, in a "one and a two, three and a four" rhythm, the "and" and the "a" beats can be de-emphasized (caused to sound the instrument softer than the "one", "two", "three" and "four" beats) . As a corollary to this, selected ones of the beats can be emphasized (accented).

The invention is beneficial because it allows the performer to operate the high-hat while double-footed bass drumming. This allows for a fuller sound to be delivered from the drum set, such as including both double-footed bass drumming and contemporaneous high-hatting. The invention is also beneficial because it can be connected directly to the instrument, or to a footpedal for operating the instrument.

It is within the scope of this invention that instruments other than a high-hat cymbal can be operated automatically. For example, the bass drum could be operated automatically. In the context of a double footpedal for the bass drum, one of the footpedals could be operated automatically (laying down a regular 1-2-3-4 beat, for example), the other bass drum footpedal could be operated by one of the performer's feet (e.g., for fills and riffs), and the other of the performer's feet would be available for operating the high-hat.

What is claimed is:

1. An automatic percussion instrument operating mechanism comprising:

an actuator operable to exert a force over a distance;

means for sequentially actuating the actuator;

means for mechanically linking the actuator to a percussion instrument so that the actuations of the actuator cause a corresponding sequence of sounds to emit from the percussion instrument; and means for causing the actuator to operate at a tempo established by another percussion instrument.

2. An automatic percussion instrument operating mechanism, according to claim 1, further comprising:

means for causing the actuator to operate with a selected rhythm based on the tempo established by the other percussion instrument.

3. An automatic percussion instrument operating mechanism, according to claim 1, further comprising:

means for causing the actuator to operate at selected beats of the tempo.

4. An automatic percussion instrument operating mechanism, according to claim 1, further comprising:

means for causing the actuator to emphasize certain beats of the tempo.

5. An automatic percussion instrument operating mechanism, according to claim 1, further comprising:

means for directly connecting the actuator to the percussion instrument.

6. An automatic percussion instrument operating mechanism, according to claim 1, further comprising:

means for establishing a regular tempo to operate the actuator from an irregular tempo as sensed from the other percussion instrument.

7. An automatic percussion instrument operating mechanism, according to claim 1, further comprising:

means for selecting a loudness at which the sounds will be emitted from the instrument.

8. An automatic percussion instrument operating mechanism comprising:

an actuator operable to exert a force over a distance;

means for sequentially actuating the actuator;

means for mechanically linking the actuator to a percussion instrument so that the actuations of the actuator cause a corresponding sequence of sounds to emit from the percussion instrument; and means for retro-fitting the actuator to a footpedal.

9. Mechanism, according to claim 8, wherein:

the means for retro-fitting comprises:

a bracket securable to a moveable element of the footpedal.

10. Mechanism, according to claim 8, wherein:

the means for retro-fitting comprises:

a bracket fittable under a stationary element of the footpedal.

11. Method of operating a percussion instrument, comprising:

connecting a mechanism to the percussion instrument;

causing the mechanism to automatically operate the percussion instrument; and causing the actuator to operate at a tempo established by an other percussion instrument.

12. Method of operating a percussion instrument, according to claim 11, wherein:

the mechanism is connected to the percussion instrument through the intermediary of a footpedal which operates the instrument.

13. Method of operating a percussion instrument, according to claim 11, further comprising:

causing the actuator to operate at a selected tempo.

14. Method, according to claim 11, further comprising:

sensing the operation of the other percussion instrument.

15. Method of operating a percussion instrument, according to claim 11, further comprising:

causing the actuator to operate at selected beats of the tempo.

16. Method of operating a percussion instrument, according to claim 11, further comprising:

establishing a regular tempo to operate the actuator from an irregular tempo as sensed from the other percussion instrument.

17. Method of operating a percussion instrument, according to claim 11, further comprising:

selecting a loudness at which the sounds will be emitted from the instrument.

18. Method of operating a percussion instrument, according to claim 11, further comprising:

the mechanism is connected directly to the percussion instrument.

19. Method of operating a percussion instrument, comprising:

connecting a mechanism to the percussion instrument;

causing the mechanism to automatically operate the percussion instrument; and causing the actuator to emphasize certain beats of a tempo.

20. Method of operating a percussion instrument, according to claim 19, further comprising:

causing the actuator to operate at a tempo established by a performer.

21. Method of operating a percussion instrument, according to claim 20, further comprising:

causing the actuator to operate at a steady, fixed rate.

22. Method of operating a percussion instrument, according to claim 19, further comprising:

selecting a loudness at which the sounds will be emitted from the instrument.

23. Method of operating a percussion instrument, according to claim 19, further comprising:

connecting the mechanism directly to the percussion instrument.

24. Mechanism, adapted in use to automatically operate a percussion instrument, comprising:

an actuator;

means for operating the actuator; and means for operating the actuator at a tempo established by operation of another percussion instrument.

25. Mechanism, adapted in use to automatically operate a percussion instrument, according to claim 24, further comprising:

means for connecting the actuator to a moveable element of a footpedal, said footpedal operable to sound the instrument; and means for connecting the actuator to a stationary element of the footpedal.

26. Mechanism, adapted in use to automatically operate a percussion instrument, according to claim 24, further comprising:

means for operating the actuator at a fixed tempo, said fixed tempo being selectable by a performer.

* * * * *